United States Patent [19]

Weaver

[11] 4,305,795

[45] Dec. 15, 1981

[54] METHOD FOR THE MANUFACTURE OF STAMPERS

[75] Inventor: Charles A. Weaver, Indianapolis, Ind.

[73] Assignee: RCA Corporation, New York, N.Y.

[21] Appl. No.: 223,480

[22] Filed: Jan. 8, 1981

[51] Int. Cl.[3] ..... C25D 1/10

[52] U.S. Cl. ..... 204/140; 204/5

[58] Field of Search ..... 204/5, 3, 4, 32 R, 38 R, 204/12, 140; 148/6.2; 134/2

[56] References Cited

U.S. PATENT DOCUMENTS 2,530,842 11/1950 Ruggieri ..... 204/5

3,998,601 12/1976 Yates ..... 204/12

FOREIGN PATENT DOCUMENTS 1377079 12/1974 United Kingdom ..... 204/140

*Primary Examiner*—T. M. Tufariello

*Attorney, Agent, or Firm*—Birgit E. Morris; Edward J. Sites

[57] ABSTRACT

It has been found that metal stampers, and more particularly nickel stampers, can be simultaneously hardened and passivated by cathodically treating the stampers in an aqueous bath of a passivation agent.

9 Claims, 1 Drawing Figure

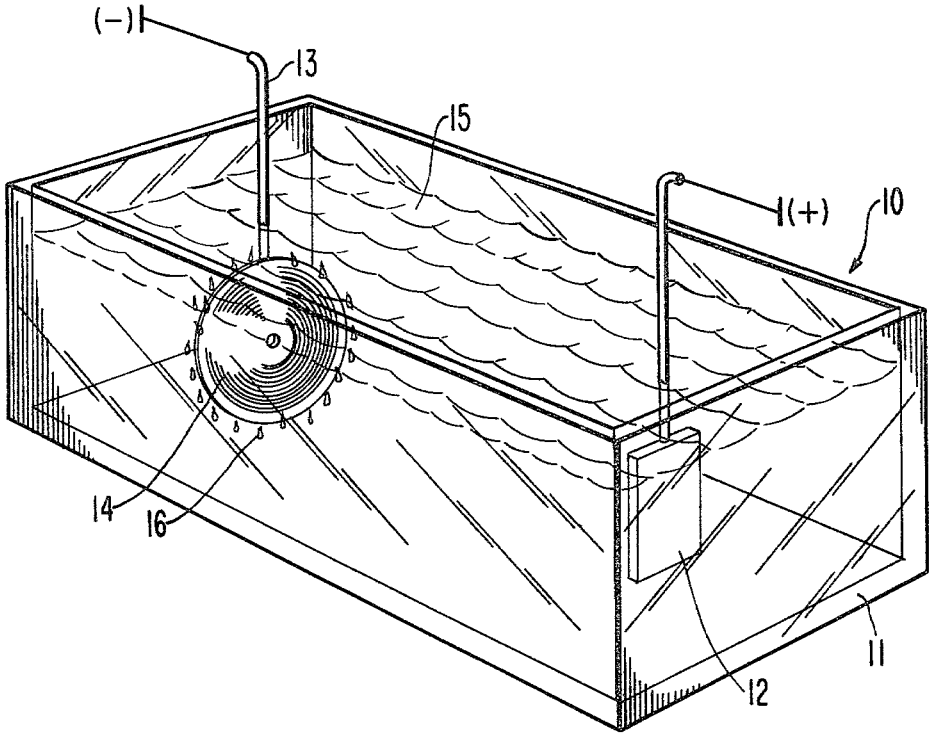
(−)
13
15
(+)
10
14
16
12
11

METHOD FOR THE MANUFACTURE OF STAMPERS

This invention relates to an improved method for the manufacture of record molding stampers and more particularly is concerned with an improved process for hardening and passivating the surface of the stampers.

BACKGROUND OF THE INVENTION

In the manufacture of molded records, it is conventional to mold a thermoplastic resin composition between a set of metal stampers to form the desired record. The metal record stampers have formed in their molding surfaces the information desired to be molded into the surface of the record.

The stampers are the final product of a replication process referred to as matrixing. The initial steps in the matrixing process is to cut the desired recording into a suitable substrate that can thereafter be replicated. Recordings for audio records are generally cut into wax or lacquer substrates. Recording for records such as video disc, and the like, where the signal elements desired to be recorded are considerably smaller than for audio records, are cut in a much harder substrate such as an electroformed copper substrate.

After the desired recording is made in the substrate, the substrate is then replicated by electroforming a metal, preferably nickel, onto the surface of the substrate. The electroformed part which is obtained is referred to as a master. The master is then replicated a number of times to produce a series of parts which are referred to as molds. The molds in turn are then replicated by electroforming a metal, preferably nickel, onto the surface of the molds to form stampers, which are negative copies of the original recorded substrate.

The stampers, after they are separated from the molds, are trimmed and shaped. The stampers are then mounted on the molding platens of a record molding press. In the operation of the press, a thermoplastic molding composition is placed between a pair of the stampers and the stampers are pressed together to form the molded record. The quality and fidelity of the molded record to the original recording is directly related to the quality of the stamper with which it is pressed.

There are a number of important properties which are required in stampers in order for the stampers to be satisfactory for the molding of records, especially in commercial production. The most important property is that the molding surface of the stamper must have sufficient release property so that the molding composition does not stick to the surface of the stamper. If the molding composition does adhere to the surface of the stamper a number of problems are encountered. Even slight sticking of the molding composition to the stamper results in distortion of the recorded signal element and as a result produces defective records. Furthermore, if the molding composition adheres strongly to the surface of the stamper, when the press is opened it can often cause distortion and destruction of the stampers as they are pulled apart by the opening action of the press.

In addition to having non-sticking properties, the surface of the stamper must likewise be scratch resistant, as any scratches on the surface of the stamper result in undesired noise in the molded record. Scratching of the stampers is a long-standing problem in the manufacture of molded records, and is especially troublesome in the manufacture of a video disc, and the like, because of the small size of the recorded signal elements in comparison to even microsize scratches. Scratching problems are especially troublesome in the manufacture of video discs because the compositions which are used in the manufacture of the video disc, contain substantial amounts of conductive carbon particles which can cause microscratching of the surface of the stampers.

A further property which is required in the stampers is that they be resistant to chemical attack. If the surfaces of the stamper are not relatively chemically inert, additives conventionally used in the molding compounds attack the surface of the stamper and cause staining of the surface of the stamper. The problem of staining is especially severe in the case of compositions used for the molding of video discs, and the like, because these compounds inherently must contain considerably greater amounts of various additives, such as mold releases, lubricants and the like.

Untreated virgin nickel stampers, as formed in the matrixing processes, have been found to be generally unsuitable for use in the molding of records on a commercial scale. The plastic compositions used for the molding of records stick excessively to virgin nickel surfaces unless substantial amounts of mold releases are added to the compositions. The addition of the mold release compounds on the other hand causes a further undesirable effect of promoting development of stains on the surface of the stampers. Untreated nickel stampers also have a relatively soft surface so that they can be easily scratched. The virgin nickel surface of the stampers is likewise quite chemically active and numerous reactions occur between the nickel stampers and the molding compositions which can cause deterioration of the quality of the molding surface of the stamper.

The method which has heretofore been widely used to provide additional protection for metal stampers, and especially for nickel stampers, is to electroplate the surface of the stampers with chromium. The chromium appears to give some additional protection to the surface of the stampers from mechanical damage, such as scratches, and also appears to passivate the surface of the stampers.

Chrome plating, however, is not a completely satisfactory solution. The amount of protection provided to the stampers by the chrome plating appears to be directly related to the relative thickness of the chrome plating applied to the surface of the stampers. Increasing the thickness of the chrome plating however, results in a corresponding decrease in the quality of the records molded from the stamper in that the chrome plating tends to fill in and obliterate the recorded signal elements in the grooves of the stamper. With conventional audio records there has generally been an accepted tradeoff of fidelity of the final recorded records in order to obtain the protection afforded by chrome plating. However, with records having extremely small recorded features, such as the video disc, it was found that the stampers could not effectively be chrome plated in that chroming virtually obliterated the recorded signal information.

A further problem of chrome plating is that even on audio stampers, and the like, chrome plating is at best a temporary to a semi-permanent treatment. On extended press runs, the chrome plating is gradually removed from the surface of the stampers. As the chrome plating is removed, there is a tendency for sticking and chemical reactions to occur at the stamper surfaces which eventually cause failure of the stampers, especially on extended press runs.

A further related problem of chrome plating is that the plating solutions that are used in the plating process, once they are spent, are extremely difficult to dispose of because of environmental pollution problems.

An additional problem encountered with chrome plating stampers, is that the chrome, when applied to the stampers, substantially reduces the scrap value of the nickel in the stampers as compared to pure nickel scrap. The reduction in cost is quite substantial, and results in increasing the overall production cost.

It would be highly advantageous if a method could be provided to treat the molding surface of metal stampers, especially nickel stampers, to make them more scratch resistant and chemically passive but which would not have the inherent disadvantage of chrome plating.

SUMMARY OF THE INVENTION

It has been found that metal stampers, and more particularly nickel stampers, can be simultaneously hardened and passivated by cathodically treating the stampers in an aqueous bath of a passivation agent.

BRIEF DESCRIPTION OF THE DRAWING

The FIGURE is a schematic illustration of apparatus suitable for the practice of the method of this invention.

DETAILED DESCRIPTION OF THE INVENTION

The record stampers which are treated in accordance with the present invention can be formed by conventional matrixing processes. Since nickel stampers are the most important class of stampers, specific reference will be made to the treatment of this type of stamper. However, it should be appreciated that other types of stampers made of other metals such as copper, iron or certain alloys can likewise be treated advantageously in accordance with the teachings of this invention, and that the treatment of such stampers is likewise included in the scope of the present invention.

In the preferred method of the present invention, the molding surface of the stamper is not treated with any protective coatings, after it is separated from the mold in matrixing. Protective coatings, such as organic plastic film, tend to leave microresidues on the surface of the stamper which contaminate the surface of the stamper in further treatments unless completely removed. If, however, a protective coating is employed, it is important that as much of the coating as possible be stripped from the stamper before treatment. Furthermore, special care should be taken in the mechanical processing of the stampers to avoid contacting the molding surface of the stamper with oils, dirt or other contaminants.

The treatment of this invention is conducted in an electrolytic bath. An apparatus 10 which is suitable for conducting the treatment is schematically illustrated in the figure. The treatment apparatus 10 consists of a tank 11 in which there is mounted an insoluble anode 12. The insoluble anode can be made of various materials, such as stainless steel and the like. A cathode 13 is mounted at the opposite end of the tank 11 in an opposing relationship to the insoluble anode 12. The cathode 13 has a holder (not shown) to which the stamper 14 is secured for treatment. The cathode 13 and the insoluble anode are electrically connected to a conventional power source (not shown). The tank 11 is filled with an aqueous mixture 15. The level of the aqueous mixture is maintained at a level such that the stamper 14 can be completely immersed in the aqueous mixture 15.

The aqueous mixture contains a passivation agent and preferably an alkali material and an alkaline cleaning agent. The passivation agent which is advantageously employed includes, for example, potassium dichromate, sodium dichromate, sodium permanganate, potassium permanganate, and mixtures of these materials, with potassium dichromate being the most preferred material. The amount of the passivation agent added to the bath should be sufficient to effectively passivate the surface of the stamper 14 when electric current is supplied to the treating apparatus 10. The amount of passivation agent will vary somewhat depending on the particular material selected; however, an amount of generally about 0.15 to 1.0 gm/l is generally quite effective for this purpose with about 0.25 gm/l of potassium dichromate giving optimum results. The amount of passivation agent should be maintained at a relatively low amount consistent with being effective as a passivation agent, rather than being present in relatively large amounts. Excessive amounts of passivation agent in the aqueous mixture tends to result in uneven passivation and staining of the treated stampers.

The alkali materials which are advantageously added to the aqueous mixture are, for example, sodium hydroxide, sodium carbonate, potassium hydroxide, and mixtures thereof, with potassium hydroxide being the preferred material. The alkali material is added to the bath in an amount of from about 7.5 to 38.5 gm/l with about 15 gm/l being optimum.

The alkaline cleaning agent which is preferably added to the aqueous treating mixture include materials, such as trisodium phosphate, tetrasodium pyrophosphate, tetrapotassium pyrophosphate, and mixtures of these materials, with tetrapotassium pyrophosphate being the most preferred material. The amount of the alkaline cleaning agent added to the bath should be about 7.5 to 38.5 gm/l with preferably about 15 gm/l being added to the bath.

An aqueous bath composition, which has been found to be highly satisfactory for use in the method of this invention, was made up of 0.25 gm/l of potassium dichromate, 15 gm/l potassium hydroxide, and 15 gm/l of tetrapotassium pyrophosphate.

In the practice of this invention, the stamper 14, which is to be treated, is mounted in the cathode 13 in the holder so as to be in electrical contact with the cathode 13. The stamper is then completely immersed into the bath 15. The cathode 13 and anode 12 are connected to a suitable power source. The bath 15 is preferably heated to and maintained at a temperature of 66° to 77° C.The current is then maintained in the bath at a sufficient level to provide a current density at the surface of the stamper which is from about 4 to 6.5 amp/dm$^2$, preferably from about 5.5 amp/dm$^2$. During treatment there will be a marked evolution of hydrogen in the form of bubbles 16 at the cathode. The hydrogen which is evolved will flow over the surface of the stamper 14. The treatment, once the evolution of the hydrogen commences, is completed quite rapidly with treatment times of one minute generally being quite adequate to achieve the desired results.

After completion of the treatment of the stamper in the aqueous bath 15, the stamper is removed from the bath 15 and rinsed with clear water and dried. The stamper 14 is now ready for use.

The stampers 14 treated, in accordance with the above method, have a unique combination of properties. The surface of the stampers are significantly hardened, as compared to the untreated surface, as is demonstrated by a substantially higher scratch resistance. The scratch resistance which is imparted by the treatment of this invention is at least equivalent to the scratch resistance imparted by chrome plating the stampers. The release properties of the stampers of this invention are also superior to the untreated stampers, and are at least equivalent to the chrome-plated stampers. Even more surprisingly, the surface of the treated stampers were found to be virtually inert to chemical attack, especially staining. In addition, the improvements imparted to the stampers by the treatment is longer lasting than chrome plating. The number of satisfactory records which can be pressed from a stamper treated in accordance with this invention is substantially greater in number than that which could be pressed with equivalent chrome-plated stampers.

A further advantage of the treatment method of the present invention is that the stampers can be treated at a substantially lower cost. Furthermore, no substantial pollution problems are encountered with the treatment process of this invention unlike the chrome-plating processes used in the prior art.

A very important advantage of the present invention is that the treatment is a surface reaction, not an additive process like chrome plating. Accordingly, there is no substantial change in the recorded signal so that the fidelity of playback of the records is improved. Because the treatment method of this invention does not obliterate the recorded signals, like chrome plating, it is now possible to use the method of the present invention for hardening and passivating stampers used in the manufacture of video disc and the like. The pressing runs for the video disc can be extended many times over as compared to the use of unplated nickel stampers which require an excessive amount of mold-release agents.

The exact mechanism by which the hardening and passivation occurs is not known, and is not intended to limit the scope of protection of this invention by any specific theory of reaction. It is, however, believed that the excellent results obtained with the method of this invention are the results of a series of simultaneous reactions occurring during the electrolytic treatment of the stamper. It is believed that the alkali and the alkaline cleaner in the bath removes the oils and contaminants from the stamper surface insuring that the surface of the stamper is clean for treatment. The most important action which is believed to occur is a simultaneous and synergistic reaction of the liberated hydrogen and the passivation agent with the surface of the stamper. The hydrogen causes a hardening of the surface of the stamper, while the passivation agent passivates the surface of the stamper. Neither reaction by itself is sufficient to protect the stamper, and the simultaneous treatment is superior to sequential treatments.

EXAMPLE

A series of stampers for audio-type records were electroformed from nickel using conventional matrixing techniques. The stampers were divided into three groups. The first group was left in the virgin nickel state. The second group was chrome plated in the standard method. The third group was treated in accordance with this invention.

Each stamper of the third group was mounted in a cathode holder. The stampers were then immersed in the electrolytic bath which contained:

15 gm/l of potassium hydroxide 15 gm/l of tetrapotassium pyrophosphate 0.25 gm/l of potassium dichromate The bath was maintained at 70° C. A direct current was applied across the bath in an amount sufficient to provide 5.5 amp/dm$^2$ at the exposed surface of the stamper. Hydrogen gas was evolved at the cathode on the surface of the stamper. After one minute, the current was shut off and the stamper removed, rinsed with water and dried.

Each type of stamper, that is the untreated stampers, the chromed stampers, and the stampers treated in accordance with this invention, were mounted on the recording molding press. Audio records were pressed from a polyvinylchloride molding composition to determine the molding properties of each type of stamper.

The untreated stampers were almost immediately found to be unsatisfactory. The molding composition stuck to the surface of the stamper excessively. Many of the stampers split apart at the edges causing them to be scrapped. The test with the untreated stampers was discontinued because of the serious problems encountered in molding. The stampers which were not damaged were removed from the press and then treated electrolytically in a bath of a passivation agent as noted above.

The stampers were used under production molding conditions to determine the average stamper life and ultimate cause of failure. The results of this life test are as follows:

| | CHROME PLATED STAMPER | STAMPER OF THIS INVENTION |
|---|---|---|
| Average number of records per stamper | 1,982 | 2,550 |
| Cause of failure: | | |
| (a) Split edges (sticking) | 39.3% | 35.0% |
| (b) Scratches | 20.3% | 21.4% |
| (c) Dents | 5.4% | 9.9% |
| (d) Stamper damage | 4.2% | 4.0% |
| (e) Miscellaneous | 30.8% | 29.7% |

The stampers treated in accordance with this invention had a significantly longer stamper life than that of the chrome-plated stampers. The causes for ultimate failure were essentially the same for both types of stampers.

The stampers which were initially used in the untreated state and thereafter removed and treated in accordance with this invention, were found after treatment to be essentially equivalent to the stampers which were treated initially.

What is claimed is:

1. The method for hardening and passivating the surface of a metal record stamper which comprises the steps of:

(a) immersing the stamper in an aqueous electrolytic bath having dissolved therein a passivation agent selected from the group consisting of sodium dichromate, potassium dichromate, sodium permanganate, potassium permanganate, and mixtures thereof wherein the passivation agent is present in an amount of from about 0.15 to 1.0 gm/l;

(b) connecting said stamper in a cathodic position in said bath;

(c) applying a current across said bath sufficient to cause the evolution of hydrogen at the cathode position, said electric current being maintained so as to provide a current density at the stamper surface of about 4 to 6.5 amp/dm$^2$; and (d) maintaining said current until the surface of the metal reacts with the evolved hydrogen;

whereby the surface of the stamper is simultaneously hardened and passivated.

2. The method according to claim 1 wherein the said passivation agent is potassium dichromate and is present in said bath in an amount of about 0.25 gm/l.

3. The method according to claim 1 wherein said aqueous electrolytic bath further contains an alkali and an alkaline cleaning agent.

4. The method according to claim 3 wherein the alkali is present in said bath in an amount from about 7.5 to about 38.5 gm/l and is selected from the group consisting of sodium hydroxide, sodium carbonate and potassium hydroxide.

5. The method according to claim 3 wherein the alkaline cleaning agent is present in said bath in an amount from about 7.5 to about 38.5 gm/l and is selected from the group consisting of trisodium phosphate, tetrasodium pyrophosphate, tetrapotassium pyrophosphate, and mixtures thereof.

6. The method according to claim 1 wherein the aqueous electrolytic bath is comprised of about 0.25 gm/l of potassium dichromate, about 15 gm/l of potassium hydroxide, and about 15 gm/l of tetrasodium pyrophosphate.

7. The method according to claim 1 wherein said bath is maintained at a temperature of from about 66° to 77° C.

8. The method according to claim 1 wherein the current density at the surface of the stamper is maintained at about 5.5 amp/dm$^2$.

9. The method according to claim 1 wherein said stamper is a nickel stamper.

* * * * *